United States Patent [19]

Buttery

[11] Patent Number: 4,551,616

[45] Date of Patent: Nov. 5, 1985

[54] HEATING APPARATUS

[75] Inventor: Michael H. C. Buttery, Tadworth, England

[73] Assignee: Thorn Emi Domestic Appliances Limited, London, England

[21] Appl. No.: 628,504

[22] Filed: Jul. 6, 1984

[30] Foreign Application Priority Data

Jul. 7, 1983 [GB] United Kingdom ..... 8318457

[51] Int. Cl.[4] ..... H05B 3/68

[52] U.S. Cl. ..... 219/460; 219/354; 219/411; 219/462; 219/463; 219/464; 219/466; 219/530; 219/531; 219/553; 313/315; 338/237

[58] Field of Search ..... 219/343, 348, 349, 350, 219/351, 352, 354, 388, 405, 411, 449, 458, 456, 459, 460, 461, 462, 463, 464, 466, 467, 530, 531, 540, 553; 313/279, 315; 338/237

[56] References Cited

U.S. PATENT DOCUMENTS

| | | | |
|---|---|---|---|
| 2,601,011 | 6/1952 | Wilcox | 219/461 |
| 2,844,699 | 7/1958 | Miskella | 219/531 |
| 2,859,368 | 11/1958 | Biggs et al. | 219/553 X |
| 3,244,859 | 4/1966 | Whiteford | 219/348 |
| 3,304,406 | 2/1967 | King | 219/411 |
| 3,316,387 | 4/1967 | Waldron | 219/354 |
| 3,355,574 | 11/1967 | Bassett, Jr. | 219/464 |
| 3,407,285 | 10/1968 | Jacobs | 219/456 |
| 3,634,722 | 1/1972 | Palmer, III | 313/315 X |
| 3,663,798 | 5/1972 | Speidel et al. | 219/464 |
| 3,870,862 | 3/1975 | Doner | 219/460 X |
| 3,967,385 | 7/1976 | Culbertson | 219/354 X |
| 4,216,370 | 8/1980 | Charvat | 219/460 |

FOREIGN PATENT DOCUMENTS

| | | |
|---|---|---|
| 843016361 | 3/1984 | European Pat. Off. . |
| 1032598 | 6/1966 | United Kingdom . |
| 1133468 | 11/1968 | United Kingdom . |
| 1273023 | 5/1972 | United Kingdom . |
| 1282656 | 7/1972 | United Kingdom . |
| 8316304 | 6/1983 | United Kingdom . |
| 8316306 | 6/1983 | United Kingdom . |
| 8320717 | 8/1983 | United Kingdom . |

*Primary Examiner*—Volodymyr Y. Mayewsky
*Attorney, Agent, or Firm*—Fleit, Jacobson, Cohn & Price

[57] ABSTRACT

Heating apparatus includes a tray having a layer of insulative material disposed in the base thereof and a number of infra-red lamps disposed thereabove. The apparatus is accommodated within a housing having a layer of glass ceramic to form a hotplate. Each end of each lamp is provided with a pinch seal enclosed within a ceramic end cap. To improve substantially dissipation of heat from the pinch seals, first apertures are provided in a hollow bar and second apertures are provided in a base plate below the pinch seals, so as to permit air to flow into the housing via the second apertures, substantially around the pinch seals, and out of the housing via the first apertures.

6 Claims, 3 Drawing Figures

HEATING APPARATUS

This invention relates to heating apparatus and in particular, though not exclusively, to such apparatus including one or more sources of infra-red radiation, as disclosed and claimed in our copending British Application No. 83 20717.

In the above-mentioned applications, the sources of infra-red radiation are infra-red lamps, each comprising a filament supported within a quartz tube. The infra-red lamp is described in greater detail and claimed in copendiing European Application No. 84 301636.1, in the name of THORN EMI plc, wherein each end of the lamp has a pinch seal with an electrical lead connected to the filament sealed therein, the lead being welded to an appropriate electrical connector. The pinch seal is enclosed within a ceramic housing which is shaped to provide location of the lamp in the correct position in the heating apparatus.

However it is necessary to maintain the pinch seals of the infra-red lamps at a relatively low temperature, for example below 350° C., to prevent oxidisation of the pinch seal, thereby prolonging the life of the lamp.

A solution to this problem of maintaining a relatively low temperature of the pinch seal has been proposed in our copending British Application No. 8316306, and copending British Application No. 8316304, in the name of THORN EMI plc, which both relate to the upward conduction of heat from the pinch seal towards a layer of ceramic material which forms a hot plate for the heating apparatus.

The object of the present invention is to provide an alternative solution to the above-identified problem, which may be more convenient to implement in some circumstances, but which may, if desired, be used in conjunction with the arrangements of the aforementioned co-pending British Application Nos. 8316304 and 8316306.

According to the invention there is provided heating apparatus accommodated within a housing, said apparatus including at least one infra-red lamp, the or each lamp comprising a filament supported within a generally tubular envelope and having, at each end thereof, a pinch seal with an electrical connection to the respective end of the filament sealed therein, characterised in that said housing includes a substantially hollow member having first apertures provided in a surface thereof, said member being disposed so that at least one of said first apertures is in contact with the ambient environment of said housing, the base of said housing having second apertures provided therein at least in the region substantially below said pinch seals, thereby permitting air to flow into said housing via said second apertures, substantially around said pinch seals, and out of said housing, via said first apertures.

Figure 1:
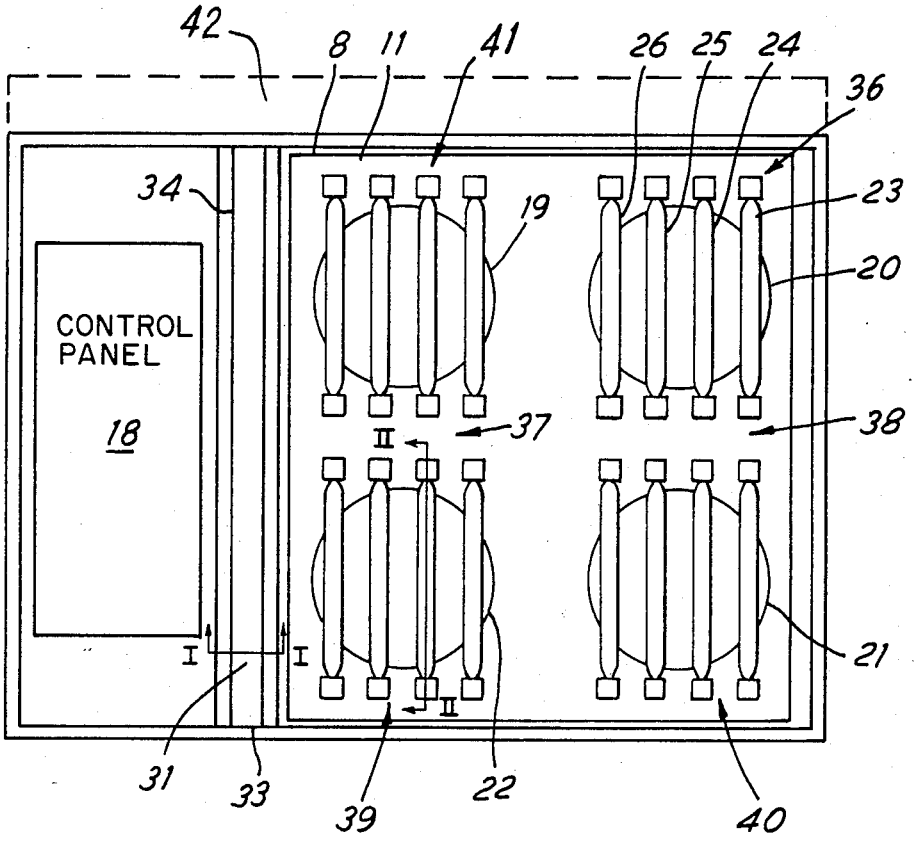
Figures 2A, 2B:
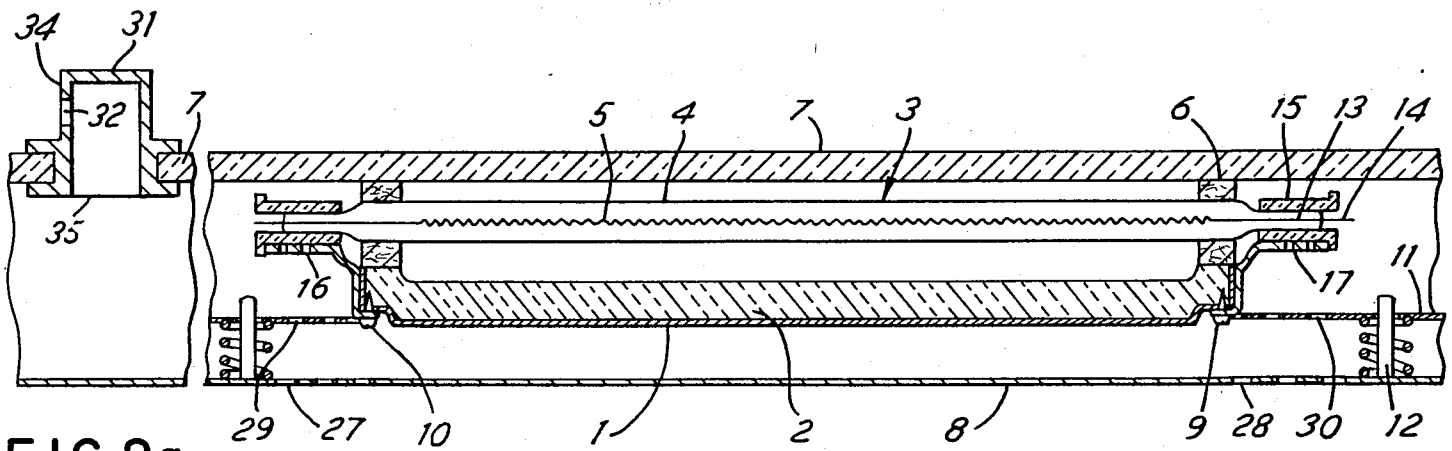

The invention will now be further described by way of example only with reference to the accompanying drawings, wherein:

FIG. 1 shows schematic plan view of an embodiment of the present invention,

FIG. 2*a* shows a section through I—I in FIG. 1, and

FIG. 2*b* shows a section through II—II in FIG. 1.

Referring to the Figures, heating apparatus, as described and claimed in our above-mentioned copending British Application No. 83 20717, consists of a generally circular tray, or so-called "flan casing" 1 having a layer 2 of insulative material, preferably one known as Microtherm, disposed in the base thereof and a number of infra-red lamps, one being shown at 3, disposed thereabove. The infra-red lamp 3 comprises a tubular quartz envelope 4 having a tungsten filament 5 supported therein, each end of the quartz envelope 4 being supported within a ceramic fibre ring 6.

Disposed above the heating apparatus is a layer 7 of glass ceramic material which forms a hot plate for the apparatus, and the apparatus is accommodated within a housing, a base plate for which is shown at 8.

The flan casing 1 is connected by screw fixings, 9 and 10, to a carrier plate 11, which is resiliently mounted to the base plate 8 by a number of pin and spring assemblies, such as at 12, which locate the carrier plate 11 and exert an upward force thereon, thereby urging the heating apparatus upwardly towards the glass ceramic layer 2 so that the top rim of the flan case abuts the underside of layer 2, thus locating and retaining the infra-red heat generated by the lamps.

Each end of the lamp 3 is provided with a pinch seal, one being shown at 13, having an amp tag connector, such as at 14, which is connected to the respective end of the filament 5, sealed therein. Electrical leads (not shown) can then be connected to each amp tag connector, so as to supply power to the infra-red lamp 3.

Both pinch seals 13 of the lamp 3 are enclosed within respective ceramic end caps, one being shown at 15, which is supported by flanges, 16 and 17, which are attached to the side wall of the flan casing 1.

It is preferable that the heating apparatus consists of four infra-red lamps disposed substantially parallel to each other and spaced across the circular region above the base of the flan casing 1. It is also preferable that a number, such as four, flan casings, each having the lamps disposed thereabove, are provided below the layer of glass ceramic material, so as to form a cooking hob. Such an arrangement is shown in the plan view of FIG. 1, wherein a user-operable control panel, to control the heat required for cooking purposes, is shown at 18, and four flan casings, 19 to 22, are also shown, each casing having four infra-red lamps, such as at 23 to 26 on casing 20, associated therewith. The four flan casings, 19 to 22, are mounted into the carrier plate 11, which is resiliently mounted to the base plate 8. For reasons of clarification, the top layer 7 of glass ceramic has been removed from the hob shown in FIG. 1.

To prolong the life of the infra-red lamps, it is necessary to maintain the pinch seals of the lamp at a relatively low temperature, this being achieved to a certain extent by the ceramic end caps which conduct a limited amount of heat from the pinch seals to the respective flanges, 16 and 17.

To improve substantially dissipation of heat from the pinch seals, the present invention includes one or more apertures, such as at 27 and 28 in the base plate 8, below the region of the pinch seals. Apertures, such as at 29 and 30, may also be provided in the area of the carrier plate 11 above the apertures in the base plate 8. In conjunction with the apertures, 27 to 30, the present invention further includes a hollow bar 31, which is provided with perforations in the form of slot apertures, such as at 32 in side 34 of the bar 31, and a slot 35 in the undersurface of the bar 31.

The bar 31 is disposed between the heating apparatus mounted in the carrier plate 11 and the control panel 18.

End 33 of the hollow bar 31 may be open to the ambient environment of the hob.

Apertures 27 to 30 are provided in the heating apparatus shown in FIG. 1 in regions, shown generally at 36 to 41, of the base plate 8 and, if required, of the carrier plate 11 below each row of pinch seals accommodated within their respective ceramic end caps.

It can therefore be envisaged that relatively cool air from the ambient environment of the cooking hob can enter the hob, via the apertures provided at least in the base plate thereof, flow around the pinch seal regions, 36 to 41, enter the bar 31 via slot 35, and then exit from the hob via the slot apertures 32 in side 34 of the bar 31, thereby providing natural cooling of the pinch seal regions by passing a constant relatively cool air-flow therearound.

In addition to apertures being provided in the base plate 8 and, if required, in the carrier plate 11, they may also be provided in the flanges, 16 and 17, which support the ceramic end caps of each lamp, and/or in the ceramic end caps 15 themselves.

The perforated bar 31 may, alternatively, be disposed in extended region 42, shown by dotted lines in FIG. 1, at the rear of the heating apparatus.

It can therefore be seen that the present invention provides a simple and inexpensive technique of naturally cooling the pinch seals of the infra-red lamps, so as to increase substantially the life of the lamps.

I claim:

1. A cooking hob comprising a housing having a base, side walls and an upper surface, said upper surface being formed from glass ceramic material; a heating unit; means for mounting said heating unit in said housing adjacent the underside of said glass ceramic surface; said heating unit comprising a tray member, a layer of thermally-insulative material accommodated in said tray member, an infra-red lamp, and means for mounting said lamp above said layer of thermally-insulative material; said lamp comprising a generally tubular envelope, a filament contained within said envelope, first and second electrical connections connected respectively to each end of said filament, and first and second pinch seals having respectively said first and second electrical connections sealed therein; electrical coupling means for coupling said first and second electrical connections to a power supply; a hollowed member, formed with aperture placing the ambient environment of said hob in communication with the interior of said hob; said base being apertured, at least in a region beneath said pinch seals, whereby air is encouraged to flow into said housing via said apertured base, around said pinch seals, and out of said housing via said hollowed member.

2. A cooking hob as claimed in claim 1 wherein said means for mounting said heating unit comprises a carrier plate resiliently mounted to the base of said housing.

3. A cooking hob as claimed in claim 2 wherein said carrier plate is also apertured at least in said region beneath said pinch seals.

4. A cooking hob as claimed in claim 1 wherein said means for mounting said lamp consists of first and second flanges for supporting respectively the ends of said lamp, said flanges being connected to opposing sides of said tray member.

5. A cooking hob as claimed in claim 4 wherein said flanges are also apertured to encourage further airflow around said pinch seals.

6. A cooking hob as claimed in claim 1 and further comprising a control arrangement including a user-operable control panel for controlling heat output from said lamp, said hollowed member being located intermediate said control panel and said heating unit.

* * * * *